US009091086B2

(12) United States Patent
Michalski et al.

(10) Patent No.: US 9,091,086 B2
(45) Date of Patent: Jul. 28, 2015

(54) SIDING PANEL SYSTEM WITH RANDOMIZED ELEMENTS

(71) Applicant: Tapco International Corporation, Wixom, MI (US)

(72) Inventors: Matthew Jason Michalski, Sylvan Lake, MI (US); Michael W Maurer, Walled Lake, MI (US); Clyde Allen, Columbiaville, MI (US); Daniel Franklin, Monroe, OH (US); Jonathan Wierengo, Novi, MI (US)

(73) Assignee: Tapco International Corporation, Wixom, MI (US)

( * ) Notice: Subject to any disclaimer, the term of this patent is extended or adjusted under 35 U.S.C. 154(b) by 123 days.

(21) Appl. No.: 13/746,133

(22) Filed: Jan. 21, 2013

(65) Prior Publication Data

US 2014/0202109 A1 Jul. 24, 2014

(51) Int. Cl.
*E04F 13/08* (2006.01)
*E04F 21/18* (2006.01)

(52) U.S. Cl.
CPC ..... *E04F 21/1844* (2013.01); *E04F 13/0875* (2013.01); *E04F 13/0894* (2013.01); *E04F 2201/026* (2013.01); *Y10T 428/24479* (2015.01)

(58) Field of Classification Search
CPC ..... E04F 13/0875; E04F 13/0894; E04F 21/1844; E04F 2201/026
See application file for complete search history.

(56) References Cited

U.S. PATENT DOCUMENTS

| | | | | |
|---|---|---|---|---|
| 4,015,391 | A * | 4/1977 | Epstein et al. | 52/520 |
| 4,343,126 | A | 8/1982 | Hoofe, III | |
| 4,598,522 | A | 7/1986 | Hoofe, III | |
| 5,072,562 | A | 12/1991 | Crick et al. | |
| 5,076,037 | A | 12/1991 | Crick et al. | |
| 5,249,402 | A | 10/1993 | Crick et al. | |
| 5,347,784 | A * | 9/1994 | Crick et al. | 52/520 |
| 5,388,381 | A | 2/1995 | Bilinski et al. | |
| 5,537,792 | A * | 7/1996 | Moliere | 52/531 |
| 5,927,044 | A | 7/1999 | Lamb et al. | |
| 6,026,624 | A | 2/2000 | Patel et al. | |
| 6,276,107 | B1 | 8/2001 | Waggoner et al. | |
| 6,336,303 | B1 | 1/2002 | Vandeman et al. | |
| 6,421,975 | B2 * | 7/2002 | Bryant et al. | 52/528 |
| 6,526,717 | B2 | 3/2003 | Waggoner et al. | |
| 6,635,218 | B2 | 10/2003 | King | |
| 6,715,250 | B2 * | 4/2004 | Bryant et al. | 52/528 |
| 6,907,702 | B2 | 6/2005 | Gilbert et al. | |
| 6,952,901 | B2 * | 10/2005 | Jacques et al. | 52/302.1 |
| 6,955,019 | B2 * | 10/2005 | Donlin et al. | 52/520 |
| 6,976,342 | B1 | 12/2005 | Kowalevich | |
| 7,008,213 | B2 | 3/2006 | King | |

(Continued)

*Primary Examiner* — Rodney Mintz
(74) *Attorney, Agent, or Firm* — Quinn Law Group, PLLC

(57) ABSTRACT

A siding system includes a plurality of siding panels having a substrate formed to define a plurality of decorative units. Each of the decorative units includes an average unit distance that is equal to the sum of an average width of the decorative units, and an average width of keyways separating the decorative units. An actual centerline of each of the decorative units is horizontally located within a maximum offset tolerance of a theoretical horizontal center of each of the decorative units. The theoretical horizontal center of each of the decorative units is located at a center location distance measured from a first vertical edge of the substrate. A second siding panel is disposed vertically above a first siding panel when attached to the wall surface. The second siding panel is horizontally offset relative to the first siding panel a panel offset distance.

15 Claims, 6 Drawing Sheets

(56) References Cited

U.S. PATENT DOCUMENTS

| | | | | |
|---|---|---|---|---|
| 7,296,989 | B2 | 11/2007 | King | |
| 7,575,701 | B2 | 8/2009 | Waggoner et al. | |
| 7,698,864 | B2 | 4/2010 | Justice et al. | |
| 7,775,008 | B2 | 8/2010 | King | |
| 7,775,009 | B2 | 8/2010 | King | |
| 7,901,757 | B2 * | 3/2011 | Strout et al. | 428/131 |
| 7,955,550 | B2 * | 6/2011 | Polk et al. | 264/547 |
| 8,020,353 | B2 | 9/2011 | Gaudreau | |
| 8,074,417 | B2 | 12/2011 | Trabue et al. | |
| 8,209,938 | B2 | 7/2012 | Gaudreau et al. | |
| 8,256,185 | B2 * | 9/2012 | Kirkey | 52/748.1 |
| 8,347,578 | B2 * | 1/2013 | Kirkey | 52/553 |
| 8,863,461 | B2 * | 10/2014 | Wagner et al. | 52/545 |
| 2004/0148884 | A1 * | 8/2004 | Jacques et al. | 52/302.1 |
| 2007/0107356 | A1 | 5/2007 | Steffes et al. | |
| 2007/0144095 | A1 | 6/2007 | King | |
| 2008/0141609 | A1 * | 6/2008 | Kirkey | 52/524 |
| 2009/0084058 | A1 | 4/2009 | Cahill et al. | |
| 2009/0100788 | A1 | 4/2009 | Gabbard et al. | |
| 2009/0293401 | A1 | 12/2009 | Lappin et al. | |
| 2009/0313934 | A1 | 12/2009 | Carlson | |
| 2010/0107530 | A1 | 5/2010 | Pietruczynik et al. | |
| 2010/0170182 | A1 | 7/2010 | Gately | |
| 2012/0291367 | A1 * | 11/2012 | Kirkey | 52/105 |
| 2014/0202106 | A1 * | 7/2014 | Wagner et al. | 52/520 |

* cited by examiner

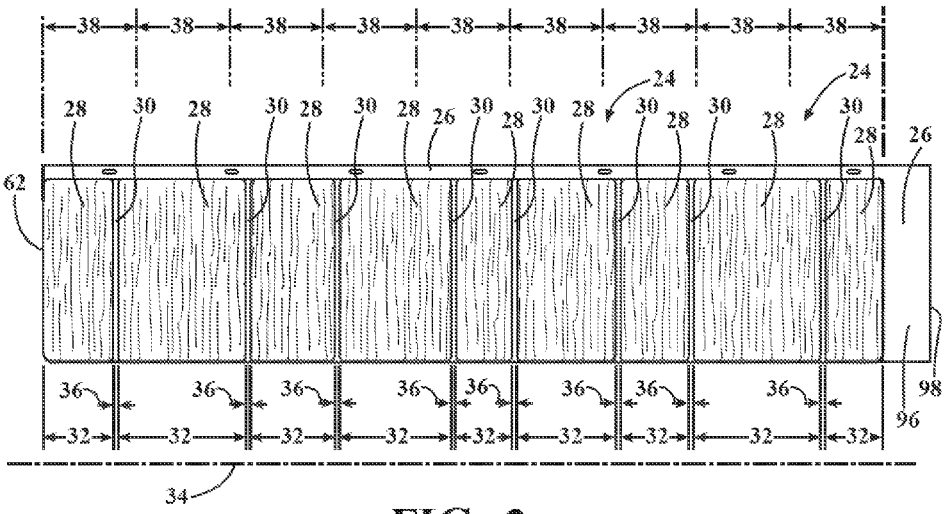
FIG. 2
FIG. 3A
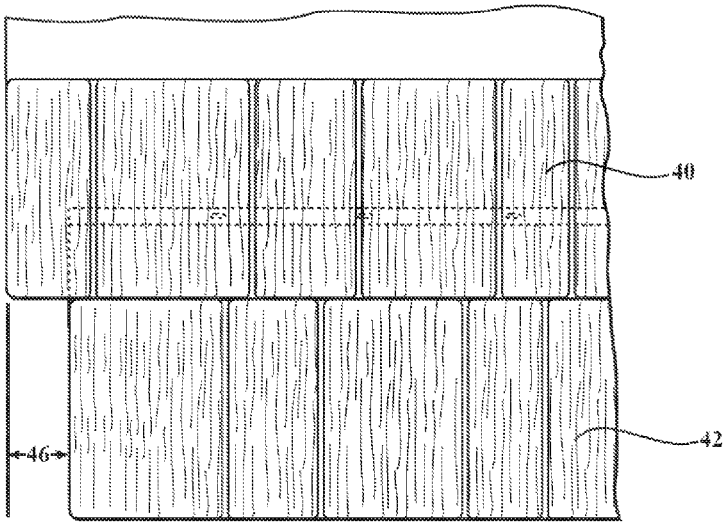

38

| | | Panel Offset Distances (44) | | | | | | | | | |
|---|---|---|---|---|---|---|---|---|---|---|---|
| | | 5" | 6" | 7" | 8" | 9" | 10" | 11" | 12" | 13" | 14" |
| n | 0 | 10.000 | 12.000 | 14.000 | 16.000 | 18.000 | 20.000 | 22.000 | 24.000 | 26.000 | 28.000 |
| | 1 | 3.333 | 4.000 | 4.667 | 5.333 | 6.000 | 6.667 | 7.333 | 8.000 | 8.667 | 9.333 |
| | 2 | 2.000 | 2.400 | 2.800 | 3.200 | 3.600 | 4.000 | 4.400 | 4.800 | 5.200 | 5.600 |
| | 3 | 1.429 | 1.714 | 2.000 | 2.286 | 2.571 | 2.857 | 3.113 | 3.429 | 3.714 | 4.000 |
| | 4 | 1.111 | 1.333 | 1.556 | 1.778 | 2.000 | 2.222 | 2.444 | 2.667 | 2.889 | 3.111 |

FIG. 4

FIG. 7

| | Decorative Units (28) 1-9 | | | | | | | | | |
|---|---|---|---|---|---|---|---|---|---|---|
| | 1 | 2 | 3 | 4 | 5 | 6 | 7 | 8 | 9 | |
| Row 1 | 6.00 | 7.00 | 5.60 | 8.00 | 5.00 | 7.00 | 5.00 | 8.20 | 5.42 | Unit Width 32 |
| Row 2 | 0.31 | 0.31 | 0.31 | 0.31 | 0.31 | 0.31 | 0.31 | 0.31 | 0.31 | Key Width 36 |
| Row 3 | 3.000 | 9.81 | 16.42 | 23.53 | 30.523 | 36.65 | 42.96 | 49.87 | 56.99 | Centerline 54 |
| Row 4 | 3.333 | 10.000 | 16.667 | 23.333 | 30.34 | 36.667 | 43.333 | 50.000 | 56.667 | Center Location Distance 60 |
| Row 5 | 0.333 | 0.190 | 0.247 | 0.20 | 0.183 | 0.017 | 0.373 | 0.130 | 0.323 | Center Offset |
| Row 6 | 1.178 | 1.678 | 0.978 | 2.178 | 0.678 | 1.678 | 0.678 | 2.300 | 0.888 | 1/2 Max.Offset Tolerance 56 |

32 56
| Unit Width | 1/2 MOT | MOT | MOT w/ max limit |
|---|---|---|---|
| 4.75 | 0.553 | 1.107 | 1.107 |
| 5.00 | 0.678 | 1.357 | 1.357 |
| 5.25 | 0.803 | 1.607 | 1.607 |
| 5.42 | 0.888 | 1.777 | 1.777 |
| 5.50 | 0.928 | 1.857 | 1.857 |
| 5.60 | 0.978 | 1.957 | 1.957 |
| 5.75 | 1.053 | 2.107 | 2.107 |
| 6.00 | 1.178 | 2.357 | 2.357 |
| 6.25 | 1.303 | 2.607 | 2.607 |
| 6.50 | 1.428 | 2.857 | 2.857 |
| 6.75 | 1.553 | 3.107 | 3.000 |
| 7.00 | 1.678 | 3.357 | 3.000 |
| 7.25 | 1.803 | 3.607 | 3.000 |
| 7.50 | 1.928 | 3.857 | 3.000 |
| 7.75 | 2.053 | 4.107 | 3.000 |
| 8.00 | 2.178 | 4.357 | 3.000 |
| 8.25 | 2.303 | 4.607 | 3.000 |
| 8.50 | 2.428 | 4.857 | 3.000 |
| 8.75 | 2.553 | 5.107 | 3.000 |
| 9.00 | 2.678 | 5.357 | 3.000 |
FIG. 8
FIG. 5
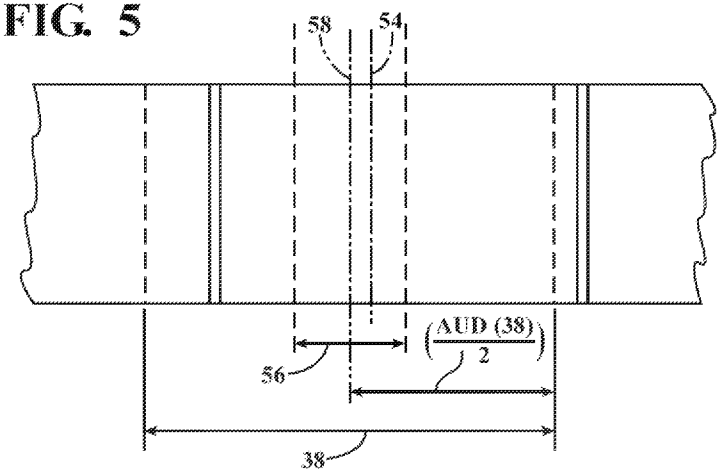
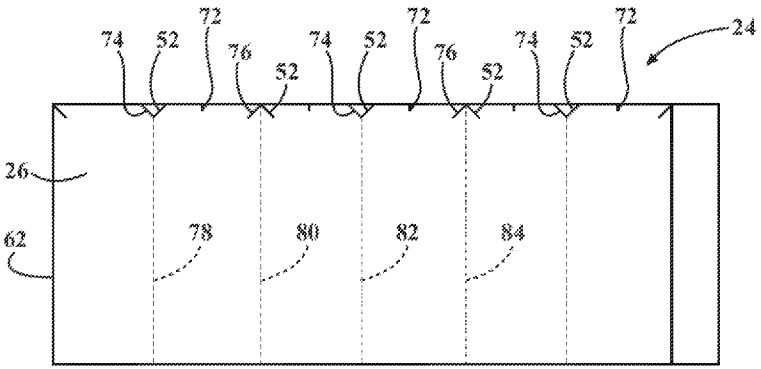
FIG. 9

SIDING PANEL SYSTEM WITH RANDOMIZED ELEMENTS

TECHNICAL FIELD

The invention generally relates to a siding system having a plurality of siding panels, and a method of installing the siding system on a wall surface.

BACKGROUND

Exterior siding systems often include a plurality of siding panels, with each of the siding panels formed to simulate a plurality of individual decorative units. For example, each siding panel may be formed to simulate multiple wood siding shakes. As such, each decorative unit is formed to simulate a single siding shake. It should be appreciated that the decorative units may be formed to simulate other siding materials, such as stone, tile, shingles, etc. The siding panel is formed with a space or keyway separating each of the decorative units. In order to provide a pleasing aesthetic appearance, the keyways on each course of siding panels should be horizontally offset from the keyways directly above or below and present a random appearance.

Furthermore, due to the tooling cost associated with manufacturing the siding panels, siding systems are generally manufactured with only one or two different panel designs and/or configurations that are installed in a repeated fashion. If one of the decorative units on the siding panels varies greatly from the other decorative units, a repeated pattern may develop that is visually noticeable. Therefore, most siding systems include decorative units that have only minor variations in size and texture to reduce the possibility of a visually noticeable repeated decorative unit.

SUMMARY

A siding panel for mounting on a wall surface is provided. The siding panel includes a substrate formed to define a plurality (n) of decorative units arranged in a single horizontal row. Each of the decorative units define a unit width, with each adjacent pair of the decorative units separated by a keyway defining a keyway width. Each of the decorative units includes an Average Unit Distance (AUD) that is equal to the sum of an average width of the decorative units measured horizontally along the substrate, and an average width of the keyways measured horizontally along the substrate. An actual centerline of each of the decorative units extends vertically. The actual centerline of each of the decorative units is horizontally located within a maximum offset tolerance of a theoretical horizontal center of each of the decorative units. The theoretical horizontal center of each of the decorative units is located at a Center Location Distance (CLD) measured from a first vertical edge of the substrate. The center location distance is calculated by the equation: $CLD_U=(U-0.5)(AUD)$, wherein U is equal to the specific decorative unit numbered sequentially from the first vertical edge of the substrate (1, 2, 3, . . . n), and AUD is the average unit distance of the decorative units.

A siding system for covering a wall surface is also provided. The siding system includes a plurality of siding panels that are configured to interlock with each other when installed. Each of the plurality of siding panels includes a substrate formed to define a plurality (n) of decorative units arranged in a single horizontal row. Each of the decorative units defines a unit width, with each adjacent pair of the decorative units separated by a keyway defining a keyway width. Each of the decorative units includes an average unit distance that is equal to the sum of an average width of the decorative units measured horizontally along the substrate, and an average width of the keyways measured horizontally along the substrate. An actual centerline of each of the decorative units extends vertically. The actual centerline of each of the decorative units is horizontally located within a maximum offset tolerance of a theoretical horizontal center of each of the decorative units. The theoretical horizontal center of each of the decorative units is located at a Center Location Distance (CLD) measured from a first vertical edge of the substrate. The center location distance is calculated by the equation: CLD=(U−0.5)(AUD), wherein U is equal to the number of the specific decorative unit numbered sequentially from the first vertical edge of the substrate (1, 2, 3, . . . n), and AUD is the average unit distance of the decorative units. The plurality of siding panels includes at least a second siding panel disposed vertically above a first siding panel when attached to the wall surface. The second siding panel is horizontally offset relative to the first siding panel a panel offset distance. The panel offset distance is defined by the equation:

$$\text{Panel Offset Distance}=(n+0.5)(\text{AUD})$$

wherein n is the number of full decorative units (0, 1, 2, 3, . . . i) horizontally disposed within the panel offset distance.

A method of installing a siding system on a wall surface is also provided. The method includes attaching a first siding panel to the wall surface to define a first course of siding panels. The first siding panel is complete and uncut. A second siding panel is cut at a first cut location to remove a first portion of the second siding panel. The first portion of the second siding panel includes a horizontal length measured horizontally along the second siding panel, which is equal to one panel offset distance. The second siding panel is attached to the wall surface directly above the first siding panel to define a second course of the siding panels. The interlocking engagement between the first siding panel and the second siding panel is inspected to verify that a vertical edge of the second siding panel is aligned with a panel alignment indicia disposed on the first siding panel.

Accordingly, when the siding panels are properly installed with each vertical course of siding panels being laterally offset a multiple of the panel offset distance, the siding panels are formed so that the keyways between the decorative units fall within a prescribed region, guaranteeing that the keyways are staggered and are not vertically aligned with the keyways directly above and below, thereby providing a pleasing aesthetic appearance.

The above features and advantages and other features and advantages of the present invention are readily apparent from the following detailed description of the best modes for carrying out the invention when taken in connection with the accompanying drawings.

BRIEF DESCRIPTION OF THE DRAWINGS

FIG. 2 is a schematic plan view of a siding panel of the siding system.

FIG. 3A is a schematic fragmentary plan view of the siding system showing a second siding panel laterally offset from a first siding panel a first panel offset distance.

FIG. 4 is a chart showing the relationship between the number of complete decorative units disposed within the panel offset distance, the panel offset distance, and the Average Unit Distance of the decorative units on each of the siding panels.

FIG. 5 is an enlarged schematic fragmentary plan view showing a second siding panel positioned vertically above a first siding panel, and showing a maximum offset tolerance for the decorative units of the siding panel.

FIG. 7 is a chart presenting the theoretical centers and the limits of the maximum offset tolerance for each of the decorative units.

FIG. 8 is a chart showing the maximum offset tolerance for various widths of the decorative units.

FIG. 9 is a schematic plan view of a siding panel showing indicia thereon for cutting and positioning the siding panels relative to each other.

DETAILED DESCRIPTION

Those having ordinary skill in the art will recognize that terms such as "above," "below," "upward," "downward," "top," "bottom," etc., are used descriptively for the figures, and do not represent limitations on the scope of the invention, as defined by the appended claims.

Figure 1:
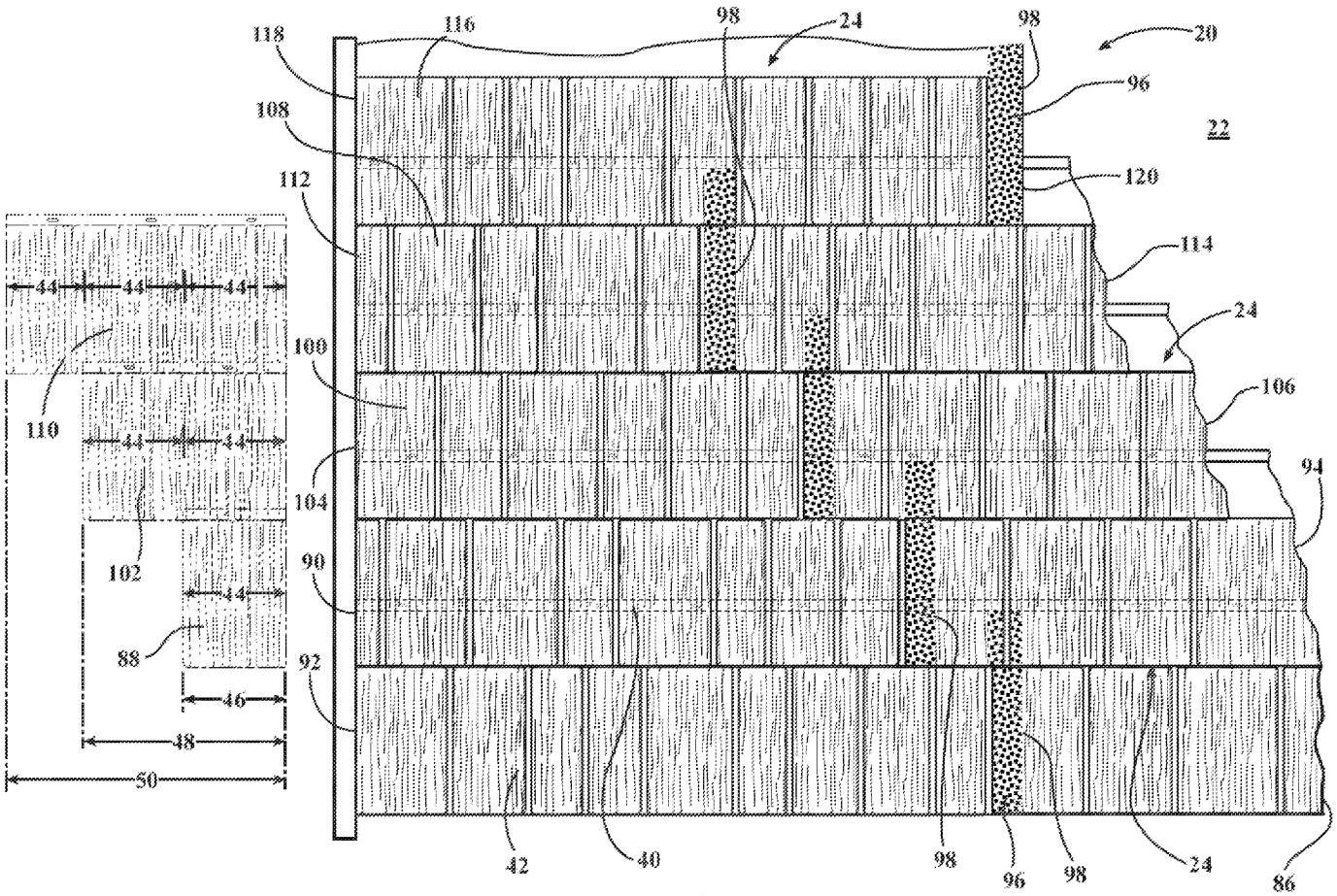
FIG. 1 is a schematic plan view of a siding system partially installed on a wall surface.

Referring to the Figures, wherein like numerals indicate like parts throughout the several views, a siding system is generally shown at 20 in FIG. 1. Referring to FIG. 1, the siding system 20 covers a wall surface 22, such as but not limited to an exterior wall surface 22 of a building. The siding system 20 includes a plurality of siding panels 24. The siding panels 24 are configured to interlock with each other when installed, as is known in the art. The siding system 20 includes several courses or rows of siding panels 24, with each course including one or more siding panels 24 installed horizontally end to end.

Referring to FIG. 2, each of the plurality of siding panels 24 includes a substrate 26 formed to define a plurality of decorative units 28. As shown in the Figures, the decorative units 28 are arranged in a single horizontal row. However, it should be appreciated that each substrate 26 may be formed to define the decorative units 28 arranged in multiple rows, e.g., the decorative units of each substrate may be arranged in two rows or three rows. Each decorative unit 28 may be formed to simulate an individual siding element, such as but not limited to a wood shake or shingle, a stone, a tile, etc. Each of the decorative units 28 is separated from the adjacent decorative units 28 on the same siding panel 24 by a space, hereinafter referred to as a keyway 30. Each of the decorative units 28 defines a unit width 32 measured horizontally along a longitudinal axis 34 of the siding panel 24. The unit width 32 of the decorative element is the actual horizontal width of the simulated siding feature. For example, if the decorative element is a simulated wood shingle, the unit width 32 is the actual horizontal width of the simulated wood shingle. It should be appreciated that the actual unit widths 32 may differ between each of the decorative units 28 on a siding panel 24. For example, the unit width 32 of each of the decorative units 28 on any of the siding panels 24 may be between the range of two inches (2") and twelve inches (12"). However, it should be appreciated that the unit widths 32 may differ from the exemplary range noted above. Furthermore, each keyway 30 defines a keyway width 36 measured horizontally along the longitudinal axis 34 of the siding panel 24. Each of the keyway widths 36 disposed between the decorative units 28 may differ from the other keyway widths 36 on each siding panel 24. Preferably, the keyway width 36 of each keyway 30 is between the range of one eighth of an inch (⅛") and one half of an inch (½"). However, it should be appreciated that the keyway width 36 may differ from the exemplary range noted above.

Each of the decorative units 28 of a siding panel 24 includes an average unit distance 38. The average unit distance 38 of the decorative units 28 on the siding panels 24 is equal to the sum of an average width of the decorative units 28 measured horizontally along the substrate 26 plus an average width of the keyways 30 measured horizontally along the substrate 26. Preferably, the average unit distance 38 for the decorative units 28 of the siding panel 24 is between the range of four inches (4") and ten inches (10"), and more preferably, the average unit distance 38 is between the range of six inches (6") and seven inches (7"). However, it should be appreciated that the average unit distance 38 may vary from the exemplary ranges noted above. For example, assuming a siding panel 24 includes nine decorative units 28 having individual unit widths 32 of: 5", 10", 6", 8", 4", 7", 5", 9", and 4", then the average width of the decorative units 28, i.e., the average of the unit widths 32, would equal 6.44". Further assuming an average keyway width, i.e., and average of the keyway widths 36, of 0.31", then the average unit distance 38 of the decorative units 28 would equal the sum of 6.44" and 0.31". Accordingly, the average unit distance 38 of the decorative units 28 for this exemplary embodiment would equal 6.75".

Referring back to FIG. 1, the plurality of siding panels 24 includes a second siding panel 40 disposed vertically above a first siding panel 42 when attached to the wall surface 22. As is known, in order to provide water resistant seams between the different rows or courses of siding panels 24, each siding panel 24 must be horizontally offset relative to the siding panel 24 directly above and below. Accordingly, the second siding panel 40 is horizontally offset relative to the first siding panel 42. The second siding panel 40 is horizontally offset relative to the first siding panel 42 a panel offset distance 44. The panel offset distance 44 may be calculated by Equation 1 below.

$$\text{panel offset distance}=(n+0.5)(\text{AUD})\pm(\text{AUD})(Z) \quad 1)$$

Within Equation 1, n is the number of full decorative units 28 (0, 1, 2, 3, . . . i) horizontally disposed within the panel offset distance 44, AUD is the average unit distance 38 of the decorative units 28 of the siding panel 24 described in detail above. and Z is a variance factor between the range of 0% and 5.0% (i.e., between 0 and 0.05).

Figure 3B:
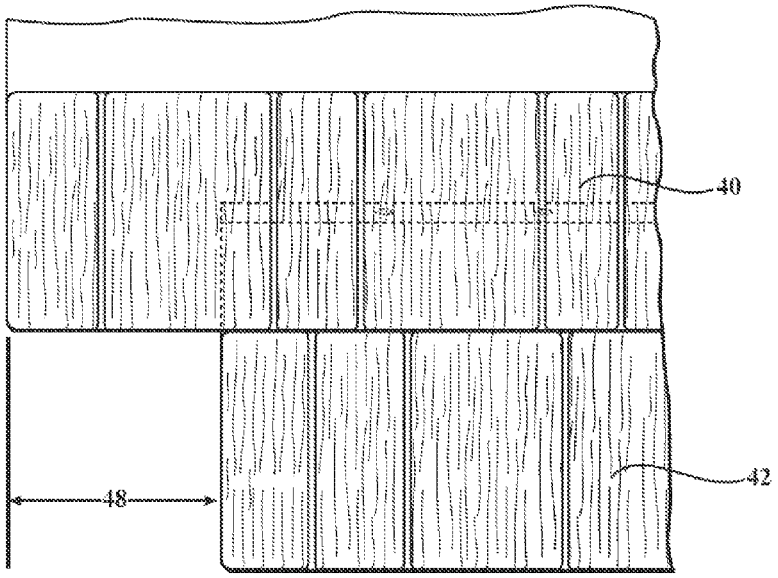
FIG. 3B is a schematic fragmentary plan view of the siding system showing the second siding panel laterally offset from the first siding panel a second panel offset distance.
Figure 3C:
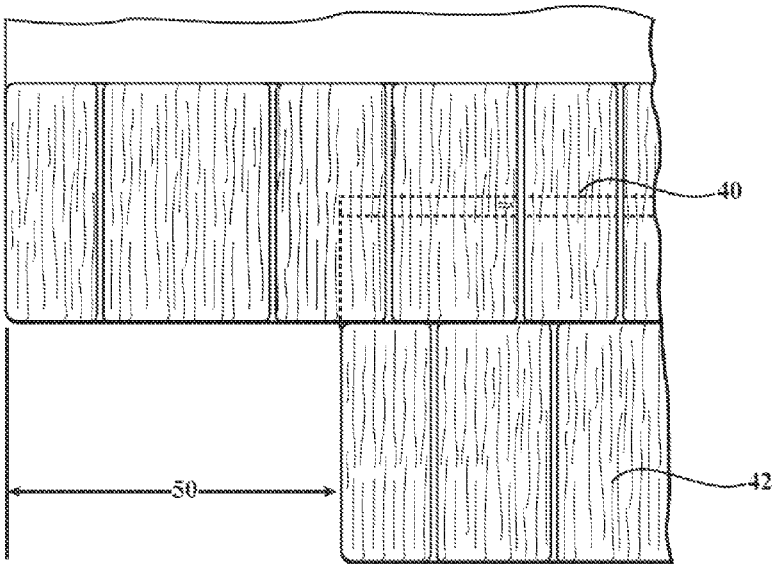
FIG. 3C is a schematic fragmentary plan view of the siding system showing the second siding panel laterally offset from the first siding panel a third panel offset distance.

Referring to FIG. 3A, the second siding panel 40 is shown horizontally offset relative to the first siding panel 42 a first offset distance 46, which includes zero (0) full decorative units 28. Accordingly, n would be equal to zero (0) in Equation 1 above when calculating the panel offset distance 44. Referring to FIG. 3B, the second siding panel 40 is shown horizontally offset relative to the first siding panel 42 a second offset distance 48, which includes one (1) full decorative unit 28. Accordingly, n would be equal to one (1) in Equation 1 above when calculating the panel offset distance 44. Referring to FIG. 3C, the second siding panel 40 is shown horizontally offset relative to the first siding panel 42 a third offset distance 50, which includes two (2) full decorative units 28. Accordingly, n would be equal to two (2) in Equation 1 above when calculating the panel offset distance 44.

Referring to FIG. 4, a chart is shown that presents the average unit distance 38 for various different panel offset distances 44 relative to the number of full decorative units 28 disposed within the panel offset distance 44, i.e., the variable n from Equation 1 above. The different panel offset distances 44 are listed at the top of each vertical column, and the number of full decorative units 28 disposed within the panel offset distance 44, i.e., the various different "n" values, are listed at the left of each horizontal row. The average unit distance 38 corresponding to the various different panel offset distances 44 and the various different "n" values are presented in the body of FIG. 4. Referring back to the example of the average unit distance 38 for the siding panel 24 described in detail above, assuming a manufacturer wanted to build a siding panel 24 with an average unit distance 38 that is approximately equal to 6.75", then FIG. 4 shows that a panel offset distance 44 equal to ten inches (10"), with an "n" value of one (1), i.e., one (1) full decorative unit 28 disposed within each panel offset distance 44, includes an average unit distance 38 of 6.667", which is near the desired 6.75". Accordingly, the manufacturer may alter the unit widths 32 of the decorative units 28 on the siding panel 24 to achieve the average unit distance 38 of 6.667". For example, assuming an average of the keyway widths 36 is equal to 0.31", then the nine decorative units 28 may be adjusted to each include individual unit widths 32 of: 6", 7", 5.60", 8", 5", 7", 5", 8.20", and 5.4", thereby rendering an average width of the decorative units 28, i.e., the average of the unit widths 32, equal to 6.356", which when added to the average of the keyway widths 36 (0.31"), produces an average unit distance equal to 6.666". By doing so, when the siding panels 24 are installed per the method described below, the keyways 30 between the different decorative units 28 on each of the siding panels 24 will not align with the keyways 30 of the siding panels 24 directly above or below, thereby providing a pleasing aesthetic appearance.

When installing the siding panels 24, the siding panels 24 are cut at multiples of the panel offset distance 44, i.e., one panel offset distance 44 (for example, 10" assuming a panel offset distance 44 of 10"), two panel offset distances 44 (for example 20" assuming a panel offset distance 44 of 10"), or three panel offset distances 44 (for example, 30" assuming a panel offset distance 44 of 10"). Each siding panel 24 must include an even number of cut locations 52 (shown in FIG. 9), i.e., 2, 4, 6, etc., to allow staggered siding panels 24 to stack correctly on the different courses, and will therefore preferably include an odd number of decorative units 28 disposed on each siding panel 24. Accordingly, a siding panel 24 having a panel offset distance 44 equal to 10", and configured to include two cut locations 52, provides a total panel coverage length of twenty inches (20"). Assuming an average unit distance 38 of 6.667", then each siding panel 24 having two cut locations 52 would include three different decorative units 28 (20"/6.667"=3 decorative units 28). Similarly, a siding panel 24 having a panel offset distance 44 equal to 10", and configured to include six cut locations 52, provides a total panel coverage length of sixty inches (60"). Assuming an average unit distance 38 of 6.667", then each siding panel 24 having six cut locations 52 would include nine different decorative units 28 (60"/6.667"=9 decorative units 28). An example of a preferable siding panel 24 includes an average unit distance 38 equal to six and two thirds inches (6.667"), a panel offset distance 44 equal to ten inches (10"), six (6) cut locations 52, and nine (9) decorative units 28. However, it should be appreciated that each siding panel 24 may be formed to include other dimensional characteristics that are different from the preferred exemplary embodiment noted above.

Referring to FIG. 5, each decorative unit 28 of the siding panel 24 includes a vertically extending centerline 54. The vertically extending centerline 54 of each decorative unit 28 is the actual horizontally located center of each decorative unit 28. The vertically extending centerline 54 is horizontally located within a maximum offset tolerance 56 of a theoretical horizontal center 58 based on the average unit distance 38 of the decorative units 28. In other words, each actual vertically extending centerline 54 of each of the decorative units 28 must lie within the maximum offset tolerance 56 of the theoretical horizontal center 58. The theoretical horizontal center 58 for each decorative unit 28 is based on the average unit distance 38 of the decorative units 28. Because the actual unit width 32 of each decorative unit 28 differs from the average unit distance 38 of the decorative units 28, the actual vertically extending centerline 54 of each of the decorative units 28 will vary from the theoretical horizontal center 58 for each decorative unit 28. The amount that the actual vertically extending centerline 54 may vary from the theoretical horizontal center 58 is limited by the maximum offset tolerance 56.

Figure 6:
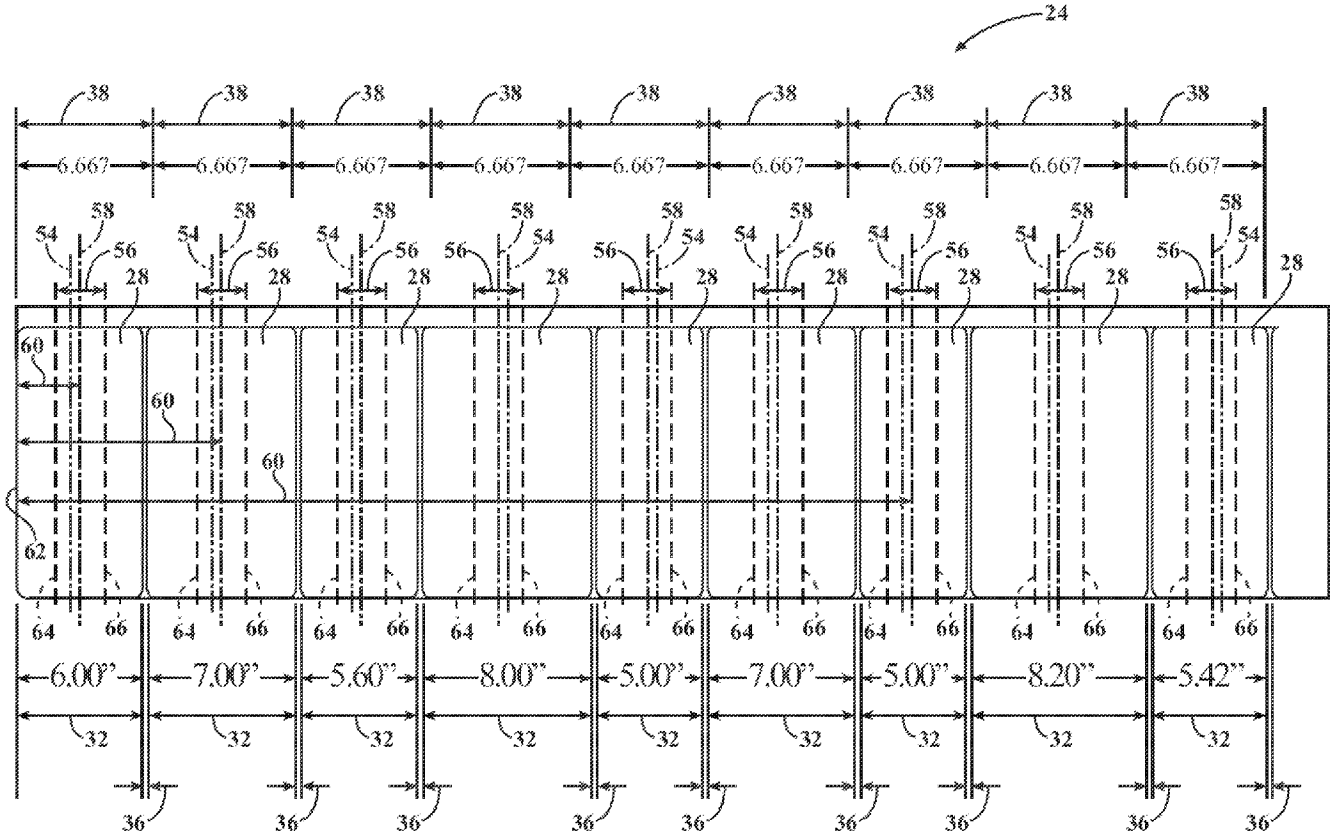
FIG. 6 is a schematic plan view of a siding panel showing a theoretical center and a maximum offset tolerance for an actual center of each of the decorative units.

Referring to FIG. 6, the theoretical horizontal center 58 of each of the decorative units 28 is located a Center Location Distance 60 (CLD) measured from a first or left vertical edge 62 of the substrate 26 of the siding panel 24, and calculated by Equation 2 below.

$$CLD_U=(U-0.5)(AUD) \qquad 2)$$

Within Equation 2, U is equal to the number of the specific decorative unit 28 numbered sequentially from the left vertical edge 62 of the substrate 26 (1, 2, 3, . . . n), and AUD is the average unit distance 38 of the decorative units 28. For example, assuming an average unit distance 38 equal to 6.667", the center location distance 60 for the first decorative unit 28, i.e., the left most decorative unit 28 on the siding panel 24, is equal to (1−0.5)(6.667")=3.333", measured from the left vertical edge 62 of the siding panel 24. Similarly, the center location distance 60 for the fifth decorative unit 28 is equal to (5−0.5)(6.667")=30", measured from the left vertical edge 62 of the siding panel 24.

Referring also to FIG. 7, each decorative unit 28 of a nine unit siding panel 24 is represented by a vertical column numbered 1 through 9. Row 1 of FIG. 7 presents the actual unit widths 32 for each of the decorative units 28 of the siding panel 24. Row 2 of FIG. 7 presents the actual keyway width 36 of each keyway. For simplicity, a common keyway width 36 of 0.31" is presented for each keyway width 36. Row 3 of FIG. 7 presents the actual location of the vertically extending centerline 54 of each decorative unit 28, measured from the left vertical edge 62 of the siding panel 24. Row 4 of FIG. 7 presents the center location distance 60 measured from the left vertical edge 62 of the siding panel 24 and assuming an average unit distance 38 equal to 6.667". It should be appreciated that the center location distance 60 represents the theoretical horizontal center 58 of each of the decorative units 28. Row 5 of FIG. 7 presents a center offset distance left or right of the theoretical horizontal center 58 of the decorative units 28. The center offset distance is the numerical difference between the center location distance 60 and the actual location of the vertically extending centerline 54. Row 6 of FIG. 7 presents one half (½) the maximum offset tolerance 56 for each decorative unit 28. As shown in FIG. 6, a left edge of the maximum offset tolerance 56 is represented by a minimum or left offset line 64 spaced from the theoretical horizontal center 58 of the decorative units 28. Furthermore, as shown in FIG. 6, a right edge of the maximum offset tolerance 56 is represented by a maximum or right offset line 66 spaced from the theoretical horizontal center 58 of the decorative units 28.

The actual horizontal center 54 of each decorative unit 28 must fall within the maximum offset tolerance 56, which is centered on the theoretical horizontal center 58 of each decorative unit 28, and disposed between the left offset line 64 and the right offset line 66.

The maximum offset tolerance 56 for each decorative unit 28 is calculated by Equation 3 below.

$$MOT = \left(\frac{AUW}{2} - KO - \frac{AUD}{4}\right)2 \quad 3)$$

Within Equation 3, MOT is the maximum offset tolerance 56; AUW is the actual unit width 32 of each decorative unit 28; KO is one half (½) the average width of the keyways 30; and AUD is the average unit distance 38 of the decorative units 28.

The maximum offset tolerance 56 is calculated by Equation 3 above, but includes a pre-defined upper limit defined by an allowable maximum limit. Accordingly, if the maximum offset tolerance 56 calculated by Equation 3 for a specific decorative unit 28 is greater than the allowable maximum limit, then the value of the maximum allowable limit is used as the maximum offset tolerance 56 for that specific decorative unit 28. Preferably, the allowable maximum limit is defined to equal three inches (3"). However, it should be appreciated that the allowable maximum limit may be defined to equal some other value not specifically described herein.

Referring to FIG. 8, a chart is presented that shows the maximum offset tolerances 56 for various different unit widths 32 of the decorative units 28. FIG. 8 assumes a value for KO is equal to 0.31", and the average unit distance 38 is equal to 6.667". As is shown in FIG. 8, once the actual unit width 32 of the decorative units 28 rises above 6.75", then the calculated value of the maximum offset tolerance 56 becomes greater than the allowable maximum limit, and the allowable maximum limit is used to define the maximum offset tolerance 56. Within FIG. 8, the allowable maximum limit is defined as 3.0".

Referring to FIG. 9, each of the siding panels 24 of the siding system 20 includes indicia printed thereon to assist in installing the siding panels 24 on the wall surface 22. The indicia include symbols or marks representing the various different cut locations 52, and a plurality of different panel alignment locations 72. The panel alignment locations 72 are described in greater detail below. As described above, each of the siding panels 24 includes a plurality of different panel cut locations 52 spaced at even increments of the panel offset distance 44 from each other. For example, assuming a panel offset distance 44 of ten inches (10"), then the panel cut locations 52 are spaced at intervals of 10", 20", 30", etc., measured from an edge of the siding panel 24, preferably the left vertical edge 62 of the siding panel 24 to facilitate left to right installation of the siding panels 24.

Preferably, and as shown in FIG. 9, the indicia indicating the panel cut locations 52 includes a first indicia symbol 74 for the odd numbered vertically stacked courses of the siding panels 24 (i.e., courses 1, 3, 5, etc.), and a second indicia symbol 76 for the even numbered vertically stacked courses of the siding panels 24 (i.e., courses 2, 4, 6, etc.). The first indicia symbol 74 and the second indicia symbol 76 are arranged in an alternating relationship horizontally along each of the siding panels 24. As such, a first cut location 78 is marked by one of the first indicia symbols 74, a second cut location 80 is marked by one of the second indicia symbols 76, a third cut location 82 is marked by one of the first indicia symbols 74, a fourth cut location 84 is marked by one of the second indicia symbols 76, and so on. The first indicia symbol 74 and the second indicia symbol 76 may include any marking. For example, the first indicia symbol 74 may include a pair of scissors open upward, and the second indicia symbol 76 may include a pair of scissors open downward. Alternatively, the first indicia symbol 74 may include a triangle pointing upward, and the second indicia symbol 76 may include a triangle pointing downward.

A method of installing the siding system 20 on the wall surface 22 is also provided. Referring to FIG. 1, the method includes forming the plurality of siding panels 24, with each of the plurality of siding panels 24 formed to include the plurality of decorative units 28 as described above. The plurality of siding panels 24 may include several different configurations of siding panels 24, all having the same general configuration. For example, all of the siding panels 24 must include the same average unit distance 38 for the decorative units 28, e.g., 6.667", include the same total number of decorative units 28, e.g., nine per siding panel 24, include the same number of cut locations 52, e.g., six. So long as these criteria are common to all different configurations of the siding panels 24, the specific sizes and/or orientations of the actual decorative units 28 on each of the different siding panels 24 may otherwise differ. Accordingly, the siding system 20 may utilize any number of different siding panels 24 to vary the appearance of the siding system 20, so long as all of the different siding panels 24 meet the various configuration characteristics noted above. By forming the different siding panels 24 in this manner, the keyways 30 between the decorative units 28 will not align with the keyways 30 of the siding panels 24 disposed directly above or below.

Once the various configurations of the siding panels 24 are formed, then each of the siding panels 24 is identically marked with the indicia. As described above, each of the siding panels 24 is marked with the indicia to indicate the different cut locations 52, and the different panel alignment locations 72. Preferably, the indicia marked on each of the siding panels 24 indicating each of the different cut locations 52 is arranged from left to right on the siding panels 24, and includes the first indicia symbol 74 and the second indicia symbol 76 as described above.

A recommended installation procedure is described herein. The first siding panel 42 is then attached to the wall surface 22. The first siding panel 42 is complete and uncut. The first siding panel 42 is attached to the wall surface 22 in a horizontal position in a manner known in the art. The first siding panel 42 defines a first course 86 of siding panels 24, which may include one or more siding panels 24 positioned end to end with the first siding panel 42. Preferably, the first course 86 of siding panels 24 is installed from left to right.

The second siding panel 40 is cut at the first cut location 78, shown in FIG. 9, to remove a first portion 88 of the second siding panel 40. The first portion 88 of the second siding panel 40 is shown in phantom to the left of the wall surface 22. The first portion 88 of the second siding panel 40 includes a horizontal length measured horizontally along the second siding panel 40 that is equal to one panel offset distance 44. For example, assuming a panel offset distance 44 of ten inches (10"), then the second siding panel 40 is cut to remove the left ten inches (10") thereof to remove the first portion 88 of the second siding panel 40.

The first portion 88 that is cut from the second siding panel 40 is disposed adjacent an edge of the second siding panel 40, whereby cutting the first portion 88 from the second siding panel 40 defines a cut edge 90 of the second siding panel 40. Preferably, the first portion 88 is located on the left side of the siding panel 24, such that the cut edge 90 of the second siding panel 40 becomes the left edge of the second siding panel 40. The second siding panel 40 is positioned relative to the first siding panel 42 such that the cut edge 90 of the second siding panel 40 is vertically aligned with an uncut left edge 92 of the first siding panel 42. The cut edge 90 of the second siding panel 40 is disposed on the left edge of the second siding panel 40 so that the first course 86 and the second course 94 of the siding panels 24 may be installed from left to right.

The second siding panel 40 is attached to the wall surface 22 directly above the first siding panel 42. The second siding panel 40 is attached to the wall surface 22 in a horizontal position in a manner known in the art. The second siding panel 40 defines a second course 94 of siding panels 24, which may include one or more siding panels 24 positioned end to end with the second siding panel 40. The second course 94 of siding panels 24 is installed from left to right. As is known in the art, each siding panel 24 includes a flange 96, shown at a right vertical edge 98 of the siding panels 24 in FIG. 1, which extends outward away from the last decorative unit 28 of the siding panel 24. The flange 96 extends underneath the next siding panel 24 installed on the course. If the second siding panel 40 is properly installed and horizontally staggered relative to the first siding panel 42, then the right vertical edge 98 of the siding panel 24, which is the distal edge of the flange 96, will align horizontally with the indicia indicating one of the panel alignment locations 72 disposed on the first siding panel 42.

Therefore, the method includes inspecting the interlocking engagement between the first siding panel 42 and the second siding panel 40 to verify that the right vertical edge 98 of the second siding panel 40 is aligned with one of the panel alignment locations 72 disposed on the first siding panel 42, shown in FIG. 9. If the right vertical edge 98 of the second siding panel 40 is aligned with one of the panel alignment locations 72 on the first siding panel 42, then the second siding panel 40 is properly installed, guaranteeing the proper relative positioning between the decorative units 28 on adjacent siding panels 24. If the right vertical edge 98 of the second siding panel 40 is not aligned with one of the panel alignment locations 72 on the first siding panel 42, then the second siding panel 40 is not properly installed, and must be corrected prior to continuing installation of the rest of the siding panels 24.

A third siding panel 100 is cut at the second cut location 80, shown in FIG. 9, to remove a second portion 102 of the third siding panel 100. The second portion 102 of the third siding panel 100 is shown in phantom to the left of the wall surface 22. The second portion 102 of the third siding panel 100 includes a horizontal length measured horizontally along the third siding panel 100 that is equal to two panel offset distances 44. For example, assuming a panel offset distance 44 of ten inches (10"), then the third siding panel 100 is cut to remove the left twenty inches (20") thereof to remove the second portion 102 of the third siding panel 100.

The second portion 102 that is cut from the third siding panel 100 is disposed adjacent an edge of the third siding panel 100, whereby cutting the second portion 102 from the third siding panel 100 defines a cut edge 104 of the third siding panel 100. Preferably, the second portion 102 is located on the left side of the third siding panel 100, such that the cut edge 104 of the third siding panel 100 becomes the left edge of the third siding panel 100. The third siding panel 100 is positioned relative to the second siding panel 40 such that the cut edge 104 of the third siding panel 100 is vertically aligned with the left cut edge 90 of the second siding panel 40. The cut edge 104 of the third siding panel 100 is disposed on the left edge of the third siding panel 100 so that the second course 94 and a third course 106 of the siding panels 24 may be installed from left to right. Furthermore, it should be appreciated that the various courses of siding panels 24 are also installed from bottom to top.

The third siding panel 100 is attached to the wall surface 22 directly above the second siding panel 40. The third siding panel 100 is attached to the wall surface 22 in a horizontal position in a manner known in the art. The third siding panel 100 defines the third course 106 of siding panels 24, which may include one or more siding panels 24 positioned end to end with the third siding panel 100. The third course 106 of siding panels 24 is installed from left to right.

The interlocking engagement between the second siding panel 40 and the third siding panel 100 is inspected to verify that the right vertical edge 98 of the third siding panel 100 is aligned with one of the panel alignment locations 72 disposed on the second siding panel 40. If the right vertical edge 98 of the third siding panel 100 is aligned with one of the panel alignment locations 72 on the second siding panel 40, then the third siding panel 100 is properly installed, guaranteeing the proper relative positioning between the decorative units 28 on adjacent siding panels 24. If the right vertical edge 98 of the third siding panel 100 is not aligned with one of the panel alignment locations 72 on the second siding panel 40, then the third siding panel 100 is not properly installed, and must be corrected prior to continuing installation of the rest of the siding panels 24.

A fourth siding panel 108 is cut at the third cut location 82, shown in FIG. 9, to remove a third portion 110 of the fourth siding panel 108. The third portion 110 of the fourth siding panel 108 is shown in phantom to the left of the wall surface 22. The third portion 110 of the fourth siding panel 108 includes a horizontal length measured horizontally along the fourth siding panel 108 that is equal to three panel offset distances 44. For example, assuming a panel offset distance 44 of ten inches (10"), then the fourth siding panel 108 is cut to remove the left thirty inches (30") thereof to remove the third portion 110 of the fourth siding panel 108.

The third portion 110 that is cut from the fourth siding panel 108 is disposed adjacent an edge of the fourth siding panel 108, whereby cutting the third portion 110 from the fourth siding panel 108 defines a cut edge 112 of the fourth siding panel 108. Preferably, the third portion 110 is located on the left side of the siding panel 24, such that the cut edge 112 of the fourth siding panel 108 becomes the left edge of the fourth siding panel 108. The fourth siding panel 108 is positioned relative to the third siding panel 100 such that the cut edge 112 of the fourth siding panel 108 is vertically aligned with the left cut edge 104 of the third siding panel 100. The cut edge 112 of the fourth siding panel 108 is disposed on the left edge of the fourth siding panel 108 so that a fourth course 114 of the siding panels 24 may be installed from left to right.

The fourth siding panel 108 is attached to the wall surface 22 directly above the third siding panel 100. The fourth siding panel 108 is attached to the wall surface 22 in a horizontal position in a manner known in the art. The fourth siding panel 108 defines the fourth course 114 of siding panels 24, which may include one or more siding panels 24 positioned end to end with the fourth siding panel 108. The fourth course 114 of siding panels 24 is installed from left to right.

The interlocking engagement between the third siding panel 100 and the fourth siding panel 108 is inspected to verify that the right vertical edge 98 of the fourth siding panel 108 is aligned with one of the panel alignment locations 72 disposed on the third siding panel 100. If the right vertical edge 98 of the fourth siding panel 108 is aligned with one of the panel alignment locations 72 on the third siding panel 100, then the fourth siding panel 108 is properly installed, guaranteeing the proper relative positioning between the decorative units 28 on adjacent siding panels 24. If the right vertical edge 98 of the fourth siding panel 108 is not aligned with one of the panel alignment locations 72 on the third siding panel 100, then the fourth siding panel 108 is not properly installed, and must be corrected prior to continuing installation of the rest of the siding panels 24.

A fifth siding panel 116 is then attached to the wall surface 22. The fifth siding panel 116 is complete and uncut. The fifth siding panel 116 is positioned adjacent and above the fourth siding panel 108 such that an uncut left edge 118 of the fifth siding panel 116 aligns with the cut left edge 112 of the fourth siding panel 108. The fifth siding panel 116 is attached to the wall surface 22 in a horizontal position in a manner known in the art. The fifth siding panel 116 defines a fifth course 120 of siding panels 24, which may include one or more siding panels 24 positioned end to end with the fifth siding panel 116. The fifth course 120 of siding panels 24 is installed from left to right. The process described above is then repeated to verify proper installation of all siding panels 24. It should be appreciated that as each siding panel 24 of each course is installed, the right vertical edge 98 of each siding panel 24 should align with one of the panel alignment locations 72 on the siding panel 24 directly below.

The above described installation procedure is the recommended installation procedure. However, it should be appreciated that the siding panels 24 may be installed in any order so long as the first indicia symbol 74 and the second indicia symbol 76 alternate on successive vertical rows.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A siding system for covering a wall surface, the siding system comprising:

a plurality of siding panels configured to interlock with each other when installed, with each of the plurality of siding panels including:

a substrate formed to define a plurality (n) of decorative units arranged in at least one horizontal row, with each of the decorative units defining a unit width, and with each adjacent pair of the decorative units separated by a keyway defining a keyway width;

wherein each of the decorative units includes an average unit distance equal to the sum of an average width of the decorative units measured horizontally along the substrate and an average width of the keyways measured horizontally along the substrate;

wherein a vertically extending actual centerline of each of the decorative units is horizontally located within a maximum offset tolerance of a theoretical horizontal center of each of the decorative units;

wherein the maximum offset tolerance for each decorative unit is defined by the equation:

$$MOT = \left(\frac{AUW}{2} - KO - \frac{AUD}{4}\right)2$$

wherein AUW is the actual unit width of each decorative unit, KO is one half (½) the average width of the keyways, and AUD is the average unit distance of the decorative units;

wherein the theoretical horizontal center of each of the decorative units is located a Center Location Distance (CLD) measured from a first vertical edge of the substrate and defined by the equation:

$$CLD_U = (U - 0.5)(AUD)$$

wherein U is equal to the number of the specific decorative unit numbered sequentially from the first vertical edge of the substrate (1, 2, 3, . . . n), and AUD is the average unit distance of the decorative units;

wherein the plurality of siding panels includes at least a second siding panel disposed vertically above a first siding panel when attached to the wall surface, with the second siding panel horizontally offset relative to the first siding panel by a panel offset distance defined by the equation:

$$\text{Panel Offset Distance} = (n + 0.5)(AUD) \pm (AUD)(Z)$$

wherein n is the number of full decorative units (0, 1, 2, 3, . . . i) horizontally disposed within the panel offset distance, and Z is a variance factor between the range of 0% and 5.0% (between 0 and 0.05); and wherein the keyways of the first siding panel are not vertically aligned with any of the keyways of the second siding panel.

2. The siding system as set forth in claim 1 wherein the width of each of the decorative units is between the range of two inches (2") and twelve inches (12").

3. The siding system as set forth in claim 2 wherein the average unit distance is between the range of four inches (4") and ten inches (10").

4. The siding system as set forth in claim 3 wherein the average unit distance is between the range of six inches (6") and seven inches (7").

5. The siding system as set forth in claim 4 wherein the panel offset distance is equal to ten inches (10").

6. The siding system as set forth in claim 5 wherein the total number of decorative units arranged on the substrate includes an odd number of decorative units.

7. The siding system as set forth in claim 6 wherein the total number of decorative units includes nine (9) decorative units.

8. The siding system as set forth in claim 1 wherein the maximum offset tolerance includes a pre-defined allowable maximum limit.

9. The siding system as set forth in claim 8 wherein the pre-defined allowable maximum limit of the maximum offset tolerance is equal to three inches (3").

10. The siding system as set forth in claim 1 wherein each of the plurality of siding panels includes a plurality of different panel cut locations spaced at even increments of the panel offset distance from each other.

11. The siding system as set forth in claim 10 wherein each of the plurality of siding panels includes an even number of panel cut locations.

12. The siding system as set forth in claim 11 wherein each of the plurality of siding panels includes an average unit distance equal to six and two thirds inches (6.667"), a panel offset distance equal to ten inches (10"), and six (6) panel cut locations.

13. The siding system as set forth in claim 10 wherein each of the plurality of siding panels includes indicia indicating each panel cut location.

14. The siding system as set forth in claim 13 wherein the indicia indicating the panel cut locations includes a first indicia symbol for odd numbered vertically stacked courses of the siding panels, and a second indicia symbol for even numbered vertically stacked courses of the siding panels, wherein the first indicia symbol and the second indicia symbol are arranged in an alternating relationship horizontally along each of the siding panels.

15. The siding system as set forth in claim 14 wherein each of the plurality of siding panels includes indicia marking a plurality of panel alignment locations.

* * * * *